United States Patent [19]

Schulz et al.

[11] 4,228,024

[45] Oct. 14, 1980

[54] INSULATING OIL COMPOSITIONS CONTAINING A FRACTION DERIVED FROM THE ALKYLATION PRODUCT OF BENZENE WITH ETHYLENE

[75] Inventors: Johann G. D. Schulz, Pittsburgh; Anatoli Onopchenko, Monroeville; William A. Kofke, Irwin, all of Pa.

[73] Assignee: Gulf Research & Development Company, Pittsburgh, Pa.

[21] Appl. No.: 954,593

[22] Filed: Oct. 25, 1978

[51] Int. Cl.[2] ..... H01B 3/22

[52] U.S. Cl. ..... 252/63

[58] Field of Search ..... 252/63; 174/17 LF; 260/671 R, 671 G, 674 A, 674 SA; 585/19, 24, 25, 450

[56] References Cited

U.S. PATENT DOCUMENTS

| | | | |
|---|---|---|---|
| 3,036,010 | 5/1962 | Freier et al. | 252/63 |
| 3,549,537 | 12/1970 | Brewster et al. | 252/63 |
| 4,045,507 | 8/1977 | Cupples et al. | 260/683.15 B |
| 4,111,824 | 9/1978 | Schulz et al. | 252/63 |
| 4,111,825 | 9/1978 | Schulz et al. | 252/63 |

FOREIGN PATENT DOCUMENTS

| | | | |
|---|---|---|---|
| 946540 | 1/1964 | United Kingdom | 252/63 |

*Primary Examiner*—Harris A. Pitlick

[57] ABSTRACT

Novel insulating oil compositions comprising a major amount of an insulating oil and a minor amount of a product obtained as a result of a process which comprises reacting benzene with ethylene in the presence of an alkylation catalyst to obtain a reaction mixture containing largely unreacted benzene, ethylbenzene, polyethylbenzenes, 1,1-diphenylethane and heavier material, separating at least benzene, ethylbenzene and polyethylbenzenes from said reaction mixture and thereafter recovering from said heavier material a fraction whose boiling points fall within a temperature range of about 255° to about 420° C. as said product.

7 Claims, No Drawings

INSULATING OIL COMPOSITIONS CONTAINING A FRACTION DERIVED FROM THE ALKYLATION PRODUCT OF BENZENE WITH ETHYLENE

BACKGROUND OF THE INVENTION

1. Field of the Invention

This invention relates to novel insulating oil compositions comprising a major amount of an insulating oil and a minor amount of a product obtained as a result of a process which comprises reacting benzene with ethylene in the presence of an alkylation catalyst to obtain a reaction mixture containing largely unreacted benzene, ethylbenzene, polyethylbenzenes, 1,1-diphenylethane and heavier material, separating at least benzene, ethylbenzene and polyethylbenzenes from said reaction mixture and thereafter recovering from said heavier material a fraction whose boiling points fall within a temperature range of about 255° to about 420° C. as said product.

2. Description of the Prior Art

Insulating oils, for example, transformer oils, are required to have low power factors and high dielectric strengths, and to be able to maintain thermal and oxidative stability toward degradation and oxidation and to possess minimum tendency toward the formation of gas while in use. See, for example, U.S. Pat. No. 3,549,537 to Brewster et al. Insulating oils composed largely of naphthenes and/or highly-branched, non-cyclic, paraffins can be used satisfactorily as transformer oils, for example, but unfortunately, they possess the tendency to produce gas during service.

SUMMARY OF THE INVENTION

We have found that the gassing characteristics of insulating oils composed largely of naphthenes and/or highly-branched, noncyclic paraffins can be greatly decreased by the addition thereto of a selected amount of a product obtained as a result of a process which comprises reacting benzene with ethylene in the presence of an alkylation catalyst to obtain a reaction mixture containing largely unreacted benzene, ethylbenzene, polyethylbenzenes, 1,1-diphenylethane and heavier material, separating at least benzene, ethylbenzene and polyethylbenzenes from said reaction mixture and thereafter recovering from said heavier material a fraction whose boiling points fall within a temperature range of about 255° to about 420° C. as said product.

BRIEF DESCRIPTION OF NOVEL INSULATING OIL COMPOSITIONS

The insulating oils used herein can be obtained from any naphthenic and/or paraffinic origin. By "naphthenic and/or paraffinic oils" we mean to include naturally-derived, or synthetic, stocks containing largely one-ring structures, such as cyclopentane and cyclohexane derivatives, two-ring structures, such as decalin and dicyclohexyl derivatives, three-, four-, and five-membered ring structures, which may be part of the same or different molecule and their mixtures, etc. The paraffinic oils are defined as being largely of highly-branched, non-cyclic, compounds. A more useful conventional definition is that developed by E. C. Lane and E. L. Garton in the "Bureau of Mines Report of Investigations No. 3279", September, 1935, and reported in "Petroleum Refining Processes" by M. M. Stephens and O. F. Spencer, 4th Edition, The Pennsylvania State University Press, University Park, Pa., 1958, page 38, in which classification is based on the gravity of the first two distillation cuts. Typical naphthenic crudes include those from Huntingdon Beach, San Joaquin, Coastal B-1, etc. Typical paraffinic crudes are the Poza Rica, Kuwait, Grand Bay/Quarantine Bay, Ordovician Crudes, etc. In addition these oils can be synthetic oils, such as those obtained as the result of the oligomerization of 1-olefins having from six to 14 carbon atoms, preferably from eight to 12 carbon atoms, such as 1-decene, mixtures of 1-decene and 1-octene, 1-dodecene, etc., as described, for example, in U.S. Pat. No. 4,045,507 to Cupples et al. Mixtures of naphthenic and paraffinic oils, including mixtures of natural and synthetic oils, can also be used, for example, in weight ratios of about 99:1 to about 1:99, preferably about 90:10 to about 10:90. In general the insulating oil used herein can be defined in accordance with the parameters set forth in Table I.

TABLE I

| | Broad Range | Preferred Range |
|---|---|---|
| Specific Gravity, 60°/60° F. (15.5°/15.5° C.) | 0.75 to 0.91 | 0.79 to 0.91 |
| Viscosity, SUS:s (ASTM D-2161) | | |
| (100° F. or 37.8° C.) | 40 to 70 | 50 to 70 |
| (210° F. or 98.9° C.) | 30 to 36.5 | 32 to 36.5 |
| Viscosity, Kin: cSt | | |
| (100° F. or 37.8° C.) | 4 to 13 | 6 to 13 |
| (210° F. or 98.9° C.) | 1.5 to 3.1 | 2 to 3.1 |
| Pour Point, (ASTM D-97) | | |
| °F. | −120 to −40 | −100 to −40 |
| °C. | −80 to −40 | −73 to −40 |
| Flash Point, (ASTM D-92) | | |
| °F. | 293 to 500 | 293 to 400 |
| °C. | 140 to 260 | 140 to 204 |
| Weight Per Cent Total Paraffin* Content | 80 to 100 | 90 to 100 |
| Weight Per Cent Aromatic Content | 0 to 20 | 0 to 10 |
| Interfacial Tension, mN/m, (ASTM D-971) | 40 to 80 | 40 to 60 |

*Highly-branched, non-cyclic paraffins, highly-branched cyclic paraffins and/or their mixtures.

The product that is added to the above insulating oils to reduce their gassing tendencies of such insulating oils are defined in applications Ser. Nos. 817,693 and 817,695 filed in the names of J. G. D. Schulz, C. M. Selwitz and A. Onopchenko, now U.S. Pat. Nos. 4,111,824 and 4,111,825, respectively. Briefly, the product is obtained by reacting benzene with ethylene to obtain a reaction mixture containing largely unreacted benzene, ethylbenzene, polyethylbenzenes, 1,1-diphenylethane and heavier material, separating at least benzene, ethylbenzene, and polyethylbenzenes from said reaction mixture and thereafter recovering from said heavier material the entire fraction, or any portion of said fraction, whose boiling points at atmospheric pressure (ambient pressure) fall within a temperature range of about 255° to about 420° C., preferably 260° to about 400° C., most preferably about 268° to about 400° C. In case 1,1-diphenyl ethane is also removed from said heavier material the product that is added to the above insulating oils is the entire fraction, or any portion of said fraction, whose boiling points at atmospheric pressure fall within a temperature range of about 275° to about 420° C., preferably about 280° to about 400° C.

The amounts of said product added to the insulating oil to inhibit the gassing tendency thereof can be varied over a wide limit, but, in general, the amount present, based on the weight of the final insulating composition, will be in the range of about five to about 20 weight percent, preferably about five to about 15 weight percent. Since the insulating oil and said product are both hydrocarbons and therefore completely miscible one in the other, mixing of the two at ambient temperature and ambient pressure until a homogeneous solution is obtained will suffice.

DESCRIPTION OF PREFERRED EMBODIMENTS

The following Table II compares the properties of the naphthenic base oil employed herein with the ASTM D-3487 insulating oil specifications for Type I Oil. The naturally-derived base oil (naphthenic) was obtained from Interprovincial Pipeline No. 1 and was a mixture of low sulfur, low pour point crudes. After conventional distillation, the fraction consisting of a 50:50 mixture of light vacuum and heavy vacuum oils (Gravity °API 25) was subjected to hydrotreating following the conditions in U.S. Pat. No. 3,764,518. The purpose of this treatment was to upgrade the product through hydrocracking, isomerization and saturation. After the first stage hydrotreatment, the product was then subjected to a second stage hydrotreatment following the conditions in Canadian Pat. No. 978,881, wherein the primary purpose of such treatment is to saturate aromatic structures with hydrogen. The product from the two stage hydrotreatment has the properties shown in Table II. The synthetic base oil was prepared in accordance with the procedure of Example 1 of U.S. Pat. No. 4,045,507 of Cupples et al, employing 1-decene as feedstock. The product from this oligomerization, after stripping off unreacted 1-decene, indicated 53 percent conversion, and was found to contain 24 weight percent dimer, the remainder being the trimer, tetramer and pentamer of 1-decene. The total product was then passed over a commercial nickel catalyst (Ni0104T, ⅛-inch pellets having a surface area of 125 square meters per gram) at 165° C. and 600 pounds per square inch gauge (41 kilograms per square centimeter) of hydrogen pressure at a rate sufficient to effect stabilization of the product through hydrogenation. Distillation under vacuum afforded the synthetic base oil used herein, a dimer fraction boiling in the temperature range of 160°–168° C. at five millimeters of mercury.

TABLE II

| Description or Test | Naturally-derived Base Oil (Naphthenic) | Synthetic Base Oil (Paraffinic) | ASTM D-3487, Insulating Oil Specifications Type I Oil |
|---|---|---|---|
| Gravity: °API (ASTM D-1298 | 34 | 46.5 | — |
| Specific Gravity, (ASTM-D941) 60°/60° F. (15.5°/15.5° C.) | 0.8550 | 0.7949 | max 0.91 |
| Viscosity, SUV: s (ASTM D-2161) | | | |
| 37.8° C. (100° F.) | 59.5 | 42.6 | max 70 |
| 98.9° C. (210° F.) | 34.7 | 31.6 | max 36.5 |
| Viscosity, Kin: cSt | | | |
| 37.8° C. (100° F.) | 10.17 | 5.06 | max 13.0 |
| 98.9° C. (210° F.) | 2.55 | 1.65 | max 3.1 |
| Interfacial Tension: mN/M (ASTM D-971) | 55 | 50 | min 40 |
| Flash, COC: °F. (°C.) (ASTM D-92) | 350 (177) | 315 (157) | min 293 (145) |
| Fire, COC: °F. (°C.) (ASTM D-92) | 370 (188) | 345 (174) | — |
| Pour Point: °F. (°C.) (ASTM D-97) | −55(−48) | below −100 (−73) | max −40 (−40) |
| Appearance (Visual) | bright | water white | clear & bright |
| Color, (ASTM D-1500) | L 0.5 | L 0.5 | max 0.5 |
| Corrosive Sulfur, (ASTM D-1275 | Non-corrosive | Non-corrosive | Non-corrosive |
| Water: PPM (ASTM D-1315 | 24 | 15 | max 35 |
| Neutralization No., (ASTM D-974) Total Acid No. | <0.03 | <0.03 | max 0.03 |
| Analine Point, (ASTM D-611): °F. (°C.) | 204 (95) | 215 (102) | 145–172 (63–78) |
| Power Factor, (ASTM D-924): Percent | | | |
| 25° C. (77° F.) | 0.002 | 0.002 | max 0.05 |
| 100° C. (212° F.) | 0.065 | 0.05 | max 0.30 |
| Dielectric Strength: Kv (ASTM D-877) | 47 | 46 | min 30 |
| Oxidation Test, (ASTM D-2440) (0.075 Percent DBPC*) | | | |
| 72 Hour | | | |
| Sludge: Percent | 0.008 | 0.001 | max 0.15 |
| Total Acid No. | 0.10 | 0.06 | max 0.5 |
| 164 Hour | | | |
| Sludge: Percent | 0.009 | 0.003 | max 0.3 |

TABLE II-continued

| Description or Test | Naturally-derived Base Oil (Naphthenic) | Synthetic Base Oil (Paraffinic) | ASTM D-3487, Insulating Oil Specifications Type I Oil |
|---|---|---|---|
| Total Acid No. | 0.10 | 0.10 | max 0.6 |
| Rotary Bomb Oxidation: Min (0.075 Percent DBPC) (ASTM D-2112), 140° C. | 125 | 480+ | — |
| Analysis, Weight Percent | | | |
| Aromatics | 0.4 | 0.0 | |
| Saturates | 99.6 | 100 Percent Branched Isoparaffins | |
| Mass Spec Analysis, Weight Percent | Alkanes 24.0 | Average Mol. Weight = 280 | |
| | 1-Ring Cycloalkanes 27.3 | | |
| | 2-Ring Cycloalkanes 18.7 | | |
| | 3-Ring Cycloalkanes 13.7 | | |
| | 4-Ring Cycloalkanes 12.0 | | |
| | 5-Ring Cycloalkanes 4.2 | | |
| | Aromatics 0.1 | | |
| Gassing Tendency; (ASTM D-2300), $mm^3$/min Procedure B, 80° C. 50 Minutes Using Hydrogen as Saturant Gas | +38.5 | +32.0 | — |

*2,6-ditertiarybutyl-p-cresol

A product for adding to the naphthenic oil was prepared as follows: Benzene and ethylene in a molar ratio of 9:1 were contacted in the liquid phase, while stirring, in a reactor at a temperature of 130° C. and a pressure of 70 pounds per square inch gauge (4.9 kilograms per square centimeter) in the presence of $AlCl_3$ catalyst over a period of one hour, which was sufficient to convert all of the ethylene. The $AlCl_3$ complex catalyst was prepared by dissolving $AlCl_3$ in a polyethylbenzene cut from a previous run so that after the addition the composition of the catalyst complex was as follows: 31:5 weight percent $AlCl_3$, 7.0 weight percent benzene, 19.3 weight percent ethylbenzene, 29.8 weight percent polyalkylated benzenes, 3.4 weight percent 1,1-diphenylethane and 9.0 weight percent higher-boiling components. The amount of $AlCl_3$ present in the catalyst mixture amounted to 0.0034 parts by weight per one part by weight of ethylbenzene produced. Also present in the catalyst was ethyl chloride as promoter in an amount corresponding 0.0034 parts by weight per one part by weight of ethylbenzene produced to maintain a high catalyst efficiency. Analysis of the alkylation product showed the presence of 49.0 weight percent benzene, 32.9 weight percent ethylbenzene, 17.5 weight percent of polyalkylated benzenes (6.0 weight percent diethylbenzene, 2.7 weight percent triethylbenzenes, 2.1 weight percent tetraethylbenzenes and 6.7 weight percent other alkylbenzenes)., 0.1 weight percent 1,1-diphenylethane and 0.4 weight percent residue. The alkylation product was subjected to distillation to recover unreacted benzene, ethylbenzene, polyalkylated benzenes and 1,1-diphenylethane, and the benzene and polyalkylated benzenes were recycled to the reaction zone. The residue remaining was a dark, viscous, high-boiling material, and was produced in an amount corresponding to 0.012 parts for each part of ethylbenzene produced. The residue so obtained was subjected to distillation to obtain a cut having a boiling point at atmospheric pressure within the temperature range of 275° to 400° C. This cut was the product added to the naphthenic oil and to the paraffinic oil in a later example. The incorporation of the product in the naphthenic oil was easily effected by physical blending, since each is miscible in the other in all proportions. Two blends were prepared, one containing 12 weight percent of the product from the residue (Blend No. 1) and the other 15 weight percent (Blend No. 2). The results obtained are tabulated below in Table III.

TABLE III

| Description or Test | Blend No. 1 | Blend No. 2 |
|---|---|---|
| Gravity: °API (ASTM D-1298) | 31.4 | 30.5 |
| Specific Gravity, (ASTM D-941) 60°/60° F. (15.5°/15.5° C.) | 0.8697 | 0.8735 |
| Viscosity, SUV: s (ASTM D-2161 | | |
| 37.8° C. (100° F.) | 55.4 | 54.9 |
| 98.9° C. (210° F.) | 34.1 | 34.0 |
| Viscosity, Kin: cSt | | |
| 37.8° C. (100° F.) | 8.99 | 8.87 |
| 98.9° C. (210° F.) | 2.34 | 2.36 |
| Interfacial Tension: mN/m (ASTM D-971) | 51 | — |
| Flash, COC: °F. (°C.) (ASTM D-92) | 345 (174) | — |
| Fire, COC °F. (°C.) (ASTM D-92) | 350 (177) | — |
| Pour Point: °F. (°C.) (ASTM D-97) | −65 (−54) | −65 (−54) |
| Appearance (Visual) | bright | bright |
| Color, ASTM D-1500 | L 0.5 | L 0.5 |
| Corrosive Sulfur, (ASTM D-1275) | Non-corrosive | — |

TABLE III-continued

| Description or Test | Blend No. 1 | Blend No. 2 |
|---|---|---|
| Water: PPM (ASTM D-1315) | 14 | — |
| Neutralization No., (ASTM D-974) | | |
| Total Acid No. | <0.03 | — |
| Aniline Point, (ASTM D-611): °F (°C.) | 186 (85) | — |
| Power Factor, (ASTM D-924): Percent | | |
| 25° C. (77° F.) | 0.002 | — |
| 100° C. (212° F.) | 0.065 | — |
| Dielectric Strength: | | |
| Kv (ASTM D-877) | 46 | — |
| Oxidation Test, (ASTM D-2440) (0.075 Percent DBPC*) | | |
| 72 Hour | | |
| Sludge: Percent | 0.002 | 0.001 |
| Total Acid No. | 0.21 | 0.21 |
| 164 Hour | | |
| Sludge: Percent | 0.003 | 0.002 |
| Total Acid No. | 0.26 | 0.26 |
| Rotary Bomb Oxidation: Min (0.075 Percent DBPC) | | |
| ASTM D-2112, 140° C. | 215 | 190 |
| Analysis, Weight Percent | | |
| Aromatics | 14.2 | — |
| Saturates | 85.8 | — |
| Gassing Tendency; (ASTM D-2300), $mm^3$/min | | |
| Procedure B, 80° C. 50 Minutes Using Hydrogen as Saturant Gas | −2.8 | −11.3 |

*2,6-ditertiarybutyl-p-cresol

The data in the above table clearly show the advantages resulting from the claimed invention. The base oil alone had a tendency to give off much gas. The mere addition of a portion of the residue from the reaction of benzene with ethylene to the base oil in fact not only greatly reduced gassing tendency of the oil but resulted in a blend having gas absorption properties. Note, too, the particularly surprising fact that the addition of inherently unstable additive to a base oil did not adversely affect the sludge and acid number and that the number of minutes when such blends were subjected to the rotary bomb oxidation tests was actually extended from 125 to at least 190. This is most unusual in light of the data in Table IV, below, which shows that the portion of the residue alone gave poor results when subjected to the Oxidation Test ASTM D-2440 and Rotary Bomb Oxidation Test ASTM D-2112. Other data in Table III show that a combination of base oil and residue from the reaction of benzene with ethylene not only gives good oxidative stability and low gassing tendencies, but that components in the mixture are compatible with each other as physical properties show.

TABLE IV

| Description or Test | Properties Portion of Residue Added to Base Oil |
|---|---|
| Specific Gravity, (ASTM D-941) 60°/60° F. (15.5°/15.5° C.) | 0.920 |
| Boiling Point, °C. | 280–400 |
| Molecular Weight | 240 |
| Viscosity, Kin: cSt (ASTM D-2161) | |
| 100° F. (37.8° C.) | 6.35 |
| 210° F. (98.9° C.) | 1.80 |

TABLE IV-continued

| Description or Test | Properties Portion of Residue Added to Base Oil |
|---|---|
| Flash Point COC: °F. (°C.) (ASTM D-92) | 310 (154) |
| Fire Point, °F. (°C.) (ASTM D-92) | 333 (167) |
| Pour Point: °F. $(°C.)_{20}$ (ASTM D-97) | −65 (−54) |
| Refractive Index, $n_D$ | 1.5555 |
| Interfacial Tension, mN/m (ASTM D-971) | 42 |
| Color, (ASTM D-1500) | L 0.05 |
| Water: PPM (ASTM D-1315) | 57 |
| Neutralization No., (ASTM D-974) | |
| Total Acid No. | 0.03 |
| Aniline Point, °F. (°C.) (ASTM D-611) | 16.7 (−8.5) |
| Dielectric Constant, (ASTM D-924) | 2.5 |
| Dielectric Strength, kV: (ASTM D-877) | 50+ |
| Power Factor, Percent: (ASTM D-924) | |
| 77° F. (25° C.) | 0.005 |
| 212° F. (100° C.) | 0.26 |
| Rotary Bomb Oxidation, (Min ASTM D-2112) 0.075 Percent DBPC* | 77 |
| Oxidation Test, (ASTM D-2440) (0.075 Percent DBPC) | |
| 72 Hour | |
| Sludge: Percent | 21.0 |
| Total Acid No. | 10.2 |
| 164 Hour | |
| Sludge: Percent | 40.0 |
| Total Acid No. | 10.4 |

*2,6-ditertiarybutyl-p-cresol

Additional tests were carried out wherein the residue added to the naphthenic oil was also added to the synthetic oil defined above. For this purpose a mixture containing 90 weight percent paraffin base oil and 10 weight percent of residue was used (Blend III). The results obtained are set forth in Table V below.

TABLE V

| Description or Test | Blend III |
|---|---|
| Gravity: °API (ASTM D-1298) | 42.2 |
| Specific Gravity, 60°/60° F. (15.5°/15.5° C.) (ASTM D-941) | 0.8146 |
| Viscosity, SUV: s (ASTM D-2161) | |
| 37.8° C. (100° F.) | 42.7 |
| 98.9° C. (210° F.) | 31.5 |
| Viscosity, Kin: cSt | |
| 37.8° C. (100° F.) | 5.10 |
| 98.9° C. (210° F.) | 1.66 |
| Interfacial Tension: mN/m (ASTM D-971) | 43 |
| Flash, COC: °F. (°C.) (ASTM D-92) | 300 (149) |
| Fire, COC: °F. (°C.) (ASTM D-92) | 330 (165) |
| Pour Point: °F. (°C.) (ASTM D-97) below −65 (−54) | |
| Appearance (Visual) | bright |
| Color (ASTM D-1500) | L.05 |
| Corrosive Sulfur (ASTM D-1275 | Non-corrosive |
| Water: PPM (ASTM D-1315) | 48 |
| Neutralization No., (ASTM D-974) | |
| Total Acid No. | <0.03 |
| Aniline Point, (ASTM D-611): °F. (°C.) | 201 (94) |
| Power Factor, (ASTM D-924): Percent | |
| 25° C. (77° F.) | 0.006 |
| 100° C. (212° F.) | 0.045 |
| Dielectric Strength: Kv (ASTM D-877) | 44 |
| Oxidation Test, (ASTM D-2440) (0.30 Percent DBPC*) | |
| 72 Hour | |
| Sludge: Percent | 0.002 |
| Total Acid No. | 0.21 |
| 164 Hour | |
| Sludge: Percent | 0.002 |
| Total Acid No. | 0.26 |

TABLE V-continued

| Description or Test | Blend III |
|---|---|
| Rotary Bomb Oxidation: | |
| Min (0.30 Percent DBPC) | 30 |
| (ASTM D-2112), 140° C. | 300+ |
| Gassing Tendency: (ASTM D-2300), $mm^3/min$ | |
| Procedure B, 80° C. | |
| 50 Minutes Using Hydrogen as Saturant Gas | −10.2 |

*2,6-ditertiarybutyl-p-cresol

The data in Table V show that a blend of residue from the reaction of benzene with ethylene and a paraffinic base oil has excellent oxidative stability, very low gassing tendency, and that the two fluids in a mixture are compatible with each other as physical properties show.

Obviously, many modifications and variations of the invention, as hereinabove set forth, can be made without departing from the spirit and scope thereof, and therefore only such limitations should be imposed as are indicated in the appended claims.

We claim:

1. A novel insulating oil composition comprising a major amount of a naphthenic hydrocarbon insulating oil and a minor amount of a product obtained as a result of a process which comprises reacting benzene with ethylene in the presence of an alkylation catalyst to obtain a reaction mixture containing largely unreacted benzene, ethylbenzene, polyethylbenzenes, 1,1-diphenylethane and heavier material, separating at least benzene, ethylbenzene and polyethylbenzenes from said reaction mixture and thereafter recovering from said heavier material a fraction whose boiling points fall within a temperature range of about 255° to about 420° C. as said product.

2. The composition of claim 1 wherein the amount of said product in the insulating oil composition is in the range of about five to about 20 weight percent.

3. The composition of claim 1 wherein the amount of said product in the insulating oil composition is in the range of about five to about 15 weight percent.

4. The composition of claim 1 wherein the boiling points of said fraction fall within a temperature range of about 260° to about 400° C.

5. The composition of claim 1 wherein the boiling points of said fraction fall within a temperature range of about 267° to about 400° C.

6. The composition of claim 1 wherein the boiling points of said fraction fall within a temperature range of about 275° to about 420° C.

7. The composition of claim 1 wherein the boiling points of said fraction fall within a temperature range of about 280° to about 400° C.

* * * * *